US006124839A

United States Patent [19]

Usui

[11] Patent Number: 6,124,839

[45] Date of Patent: Sep. 26, 2000

[54] LIQUID CRYSTAL DISPLAY DRIVING CIRCUIT AND LIQUID CRYSTAL DISPLAY HAVING PARALLEL RESONANT CIRCUIT FOR REDUCED POWER CONSUMPTION

[75] Inventor: Yuzo Usui, Kawasaki, Japan

[73] Assignee: Fujitsu Limited, Kawasaki, Japan

[21] Appl. No.: 08/756,636

[22] Filed: Nov. 26, 1996

[30] Foreign Application Priority Data

Jul. 5, 1996 [JP] Japan ..... 8-176852

[51] Int. Cl.[7] ..... G09G 3/36

[52] U.S. Cl. ..... 345/94; 345/204

[58] Field of Search ..... 345/98, 100, 94, 345/96, 204, 209, 211, 212, 52, 90

[56] References Cited

U.S. PATENT DOCUMENTS

| | | | |
|---|---|---|---|
| 3,991,416 | 11/1976 | Byles et al. | 345/87 |
| 5,323,305 | 6/1994 | Ikeda et al. | 363/98 |
| 5,717,437 | 2/1998 | Sano et al. | 345/211 |
| 5,841,410 | 11/1998 | Oda et al. | 345/58 |

*Primary Examiner*—Jeffery Brier
*Attorney, Agent, or Firm*—Greer, Burns & Crain, Ltd.

[57] ABSTRACT

A LCD driving circuit drives a LCD panel having a data electrode and a common electrode by applying a periodically inverted signal to the common electrode. The LCD driving circuit includes a parallel resonant circuit which has a static capacitance of the LCD panel and is coupled to the common electrode and ground. The parallel resonant circuit has a parallel resonance frequency equal to a frequency of the signal applied to the common electrode.

14 Claims, 7 Drawing Sheets

LIQUID CRYSTAL DISPLAY DRIVING CIRCUIT AND LIQUID CRYSTAL DISPLAY HAVING PARALLEL RESONANT CIRCUIT FOR REDUCED POWER CONSUMPTION

BACKGROUND OF THE INVENTION

The present invention generally relates to liquid crystal display driving circuits and liquid crystal display units, and more particularly to a liquid crystal display driving circuit which drives a liquid crystal display panel with lower power consumption and to a liquid crystal display unit having such a liquid crystal display driving circuit.

When a D.C. voltage is continuously applied to a liquid crystal display (LCD) panel of a LCD unit, a phenomenon called burn-in occurs whereby displays remain on the LCD panel. For this reason, an operation which is sometimes referred to as an A.C. type drive is carried out to invert the polarity of the voltage applied to the LCD panel at a predetermined period.

The A.C. type drive can generally be categorized into a method which inverts the polarity of the driving voltage with respect to a voltage of a common electrode, and a method which periodically inverts the voltage of the common electrode. In this specification, the former method will be referred to as a fixed drive method, and the latter method will be referred to as an inversion drive method, for the sake of convenience.

According to the fixed drive method, a voltage of 0 V is applied to a common electrode of the LCD panel, and a data electrode is driven by a voltage having both polarities such as +5 V and −5 V, as shown in FIG. 1A. As a result, an A.C. type signal shown in FIG. 1B is obtained. However, because the data electrode is driven by the voltage having both the positive and negative polarities, the construction of a LCD driving circuit becomes complex.

On the other hand, according to the inversion drive method, the common electrode of the LCD panel is driven as shown in FIG. 2A. As a result, an A.C. type signal shown in FIG. 2B is obtained. However, because the common electrode is driven, the power consumption is large due to the large load which is driven.

Equipment which use the LCD unit are generally driven by batteries, and it is desirable to reduce the power consumption of the LCD unit in order to extend the serviceable life of the batteries. For this reason, most of the conventional equipments which use the LCD unit employ the fixed drive method described above. But in order to reduce the cost of the LCD unit and to further reduce the power consumption of the LCD unit, it is desirable to simplify the construction of the LCD driving circuit.

According to the inversion drive method described above, a power P which is consumed to simply drive the common electrode can be obtained from the following formula, where f denotes a frequency of the A.C. type signal which is 30 kHz, V denotes a voltage of 5 V, and Cp denotes a total capacitance of the common electrode.

$$P=Cp\cdot V^2\cdot f=0.5(\mu F)\cdot 5(V)\cdot 5(V)\cdot 30(kHz)=375(mW)$$

Generally, the total power consumption of the LCD driving circuit described above is on the order of 1 W, for example. Hence, the power P that is consumed to simply obtain the A.C. type signal accounts for approximately 40% of the total power consumption of the LCD driving circuit.

Therefore, the conventional LCD driving circuit had a problem in that a large portion of the total power consumption of the LCD driving circuit is used up in order to obtain the A.C. type signal.

In order to reduce the power consumption of the LCD driving circuit, that is used up to obtain the A.C. type signal, it is conceivable to reduce the total capacitance Cp of the common electrode, the voltage V and the frequency f of the A.C. type signal.

The total capacitance Cp of the common electrode is dependent on the characteristics and size of the LCD panel. But recently, the size of the LCD panel has become relatively large and the internal structure of the LCD panel has become more miniaturized and complex. For this reason, the total capacitance Cp of the common electrode has a tendency of increasing with the increased size and complexity of the LCD panel, and it is difficult to reduce the total capacitance Cp of the common electrode.

The power P that is consumed in order to obtain the A.C. type signal is proportional to the square of the voltage V. For this reason, if the voltage V is reduced from 5 V to 3.3 V, for example, it would be possible to reduce the power consumption P to approximately one-half. However, it is difficult to greatly reduce the voltage V in actual practice due to various restrictions posed by circuit parts of the LCD driving circuit other than the circuit part which obtains the A.C. type signal, and there is a limit to greatly reducing the voltage V.

In addition, the frequency f of the A.C. type signal has already been reduced close to the limit in order to prevent the burn-in described above and the flicker that is visible to the human eyes. Thus, it is extremely difficult to further and considerably reduce the frequency f.

Therefore, it was difficult to reduce the power that is consumed in order to obtain the A.C. type signal in the conventional LCD driving circuit, and it was impossible to greatly reduce the power consumption of the LCD driving circuit.

SUMMARY OF THE INVENTION

Accordingly, it is a general object of the present invention to provide a novel and useful LCD driving circuit and LCD unit, in which the problems described above are eliminated.

Another and more specific object of the present invention is to provide a LCD driving circuit which can greatly reduce the power consumption of the LCD driving circuit by greatly reducing the power that is consumed in order to obtain an A.C. type signal, and to provide a LCD unit which includes such a LCD driving circuit.

Still another object of the present invention is to provide a LCD driving circuit which drives a LCD panel having a data electrode and a common electrode by applying a periodically inverted signal to the common electrode, comprising a parallel resonant circuit, including a static capacitance of the LCD panel, coupled to the common electrode and ground, where the parallel resonant circuit has a parallel resonance frequency equal to a frequency of the signal applied to the common electrode. According to the LCD driving circuit of the present invention, it is possible to greatly reduce the power that is consumed in order to obtain an A.C. type signal by use of a simple circuit construction. For this reason, it is possible to greatly reduce the power consumption of the LCD driving circuit.

A further object of the present invention is to provide a LCD unit comprising a LCD panel having a data electrode and a common electrode, and a LCD driving circuit driving the LCD panel by applying a periodically inverted signal to the common electrode, where the LCD driving circuit has a parallel resonant circuit which includes a static capacitance of the LCD panel and is coupled to the common electrode and ground, and the parallel resonant circuit has a parallel resonance frequency equal to a frequency of the signal applied to the common electrode. According to the LCD unit of the present invention, it is possible to greatly reduce the power that is consumed in order to obtain an A.C. type signal by use of a simple circuit construction. For this reason, it is possible to greatly reduce the power consumption of the LCD driving circuit and thus the power consumption of the LCD unit.

Other objects and further features of the present invention will be apparent from the following detailed description when read in conjunction with the accompanying drawings.

DESCRIPTION OF THE PREFERRED EMBODIMENTS

Figure 1A:
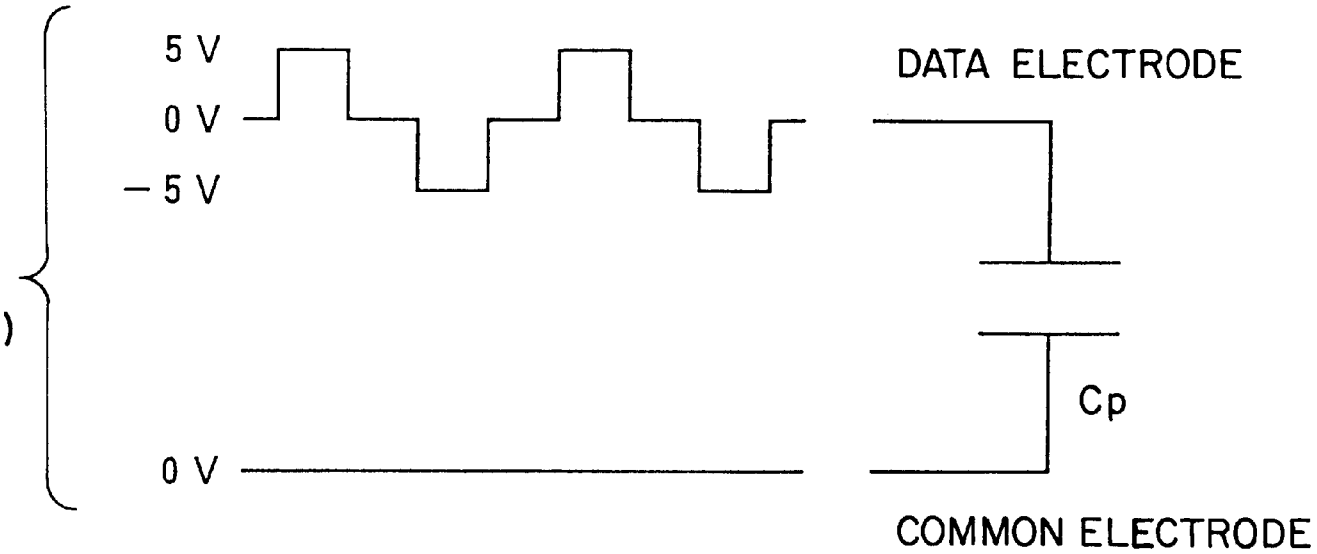
FIG. 1A (PRIOR ART)
FIGS. 1A and 1B respectively are diagrams for explaining the operation of a conventional LCD driving circuit employing a fixed drive method.
Figure 1B:
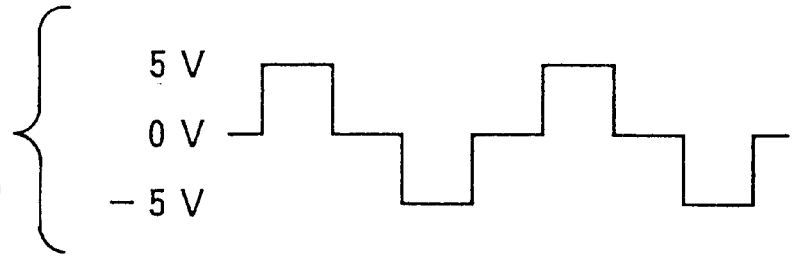
FIG. 1B (PRIOR ART)
Figure 2A:
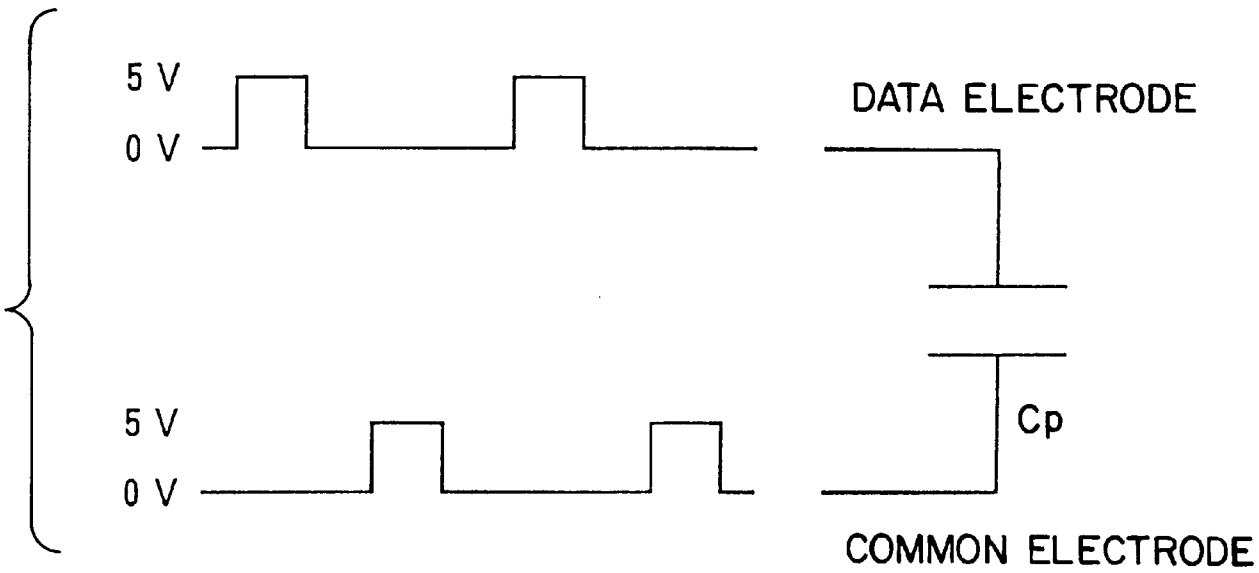
FIG. 2A (PRIOR ART)
FIGS. 2A and 2B respectively are diagrams for explaining the operation of a conventional LCD driving circuit employing an inversion drive method.
Figure 2B:
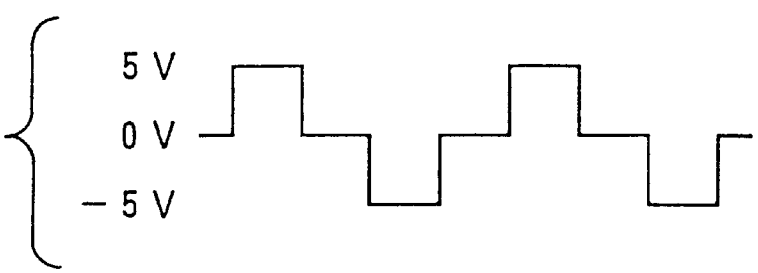
FIG. 2B (PRIOR ART)
Figure 3:
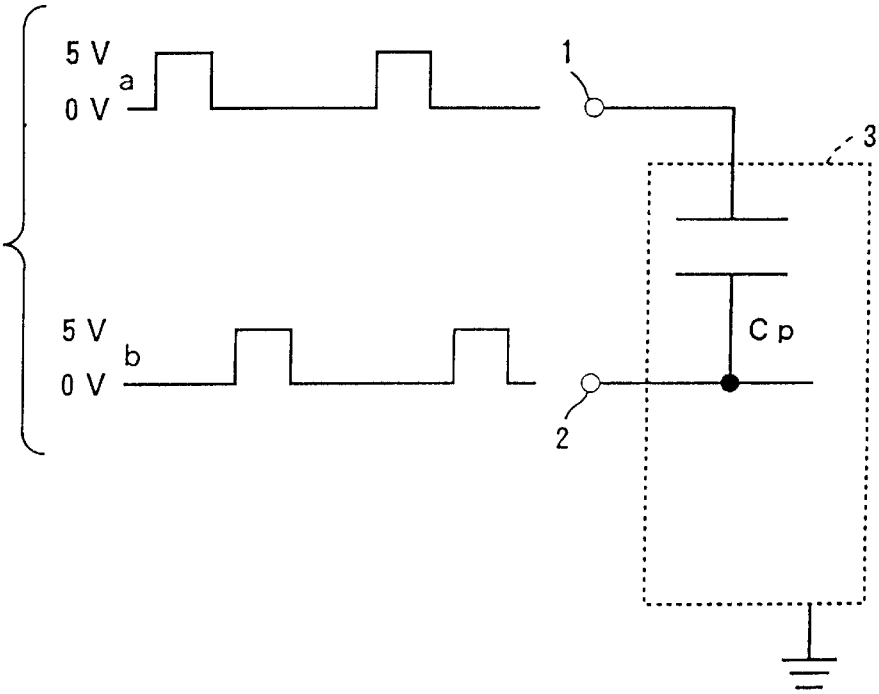
FIG. 3 is a diagram for explaining the operating principle of a LCD driving circuit according to the present invention.

First, a description will be given of the operating principle of a LCD driving circuit according to the present invention, by referring to FIG. 3. FIG. 3 shows the general construction of the LCD driving circuit according to the present invention.

In the LCD driving circuit shown in FIG. 3, a voltage a is applied to a data terminal 1 of a LCD panel (not shown) and a voltage b is applied to a common electrode 2 of the LCD panel. In other words, the present invention employs the inversion drive method described above. Circuit parts of the LCD driving circuit which generate such voltages a and b are known, and a description and illustration thereof will be omitted in this application. Cp denotes a total capacitance of the common electrode 2, that is, the static capacitance of the LCD panel. A parallel resonant circuit 3 includes this total capacitance Cp, and this parallel resonant circuit 3 is coupled to the common electrode 2 and the ground. A parallel resonance frequency of this parallel resonant circuit 3 is selected equal to the frequency of the voltage b that is applied to the common electrode 2.

A LCD unit according to the present invention includes the LCD driving circuit shown in FIG. 3.

According to the present invention, it is possible to greatly reduce the power that is consumed in order to obtain an A.C. type signal, and the power consumption of the LCD driving circuit can be reduced considerably.

Figure 4:
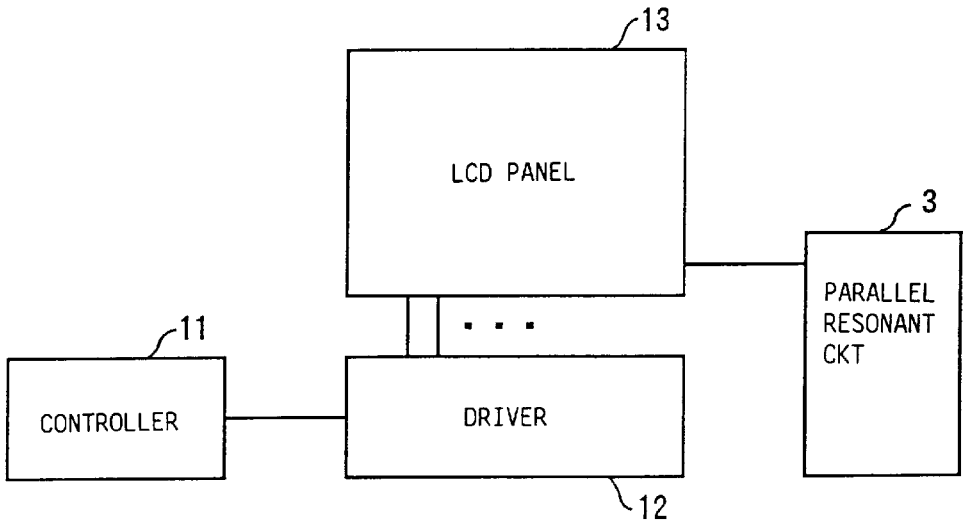
FIG. 4 is a system block diagram showing an embodiment of a LCD unit according to the present invention.

FIG. 4 shows the general construction of an embodiment of the LCD unit according to the present invention. This LCD unit includes a controller 11, a driver 12, a LCD panel 13 and a parallel resonant circuit 3 which are connected as shown in FIG. 4. The LCD panel 13 is formed on a substrate (not shown), and the driver 12 and/or controller 11 may be provided on this substrate or connected externally to the substrate. For example, when the driver 12 and the LCD panel 13 are provided on the same substrate, a semiconductor chip forming the driver 12 may be connected on the substrate or, the driver 12 may be formed directly on the substrate.

The controller 11 controls the entire operation of the LCD unit. The driver 12 drives the LCD panel 13 based on data from the controller 11, and controls ON/OFF states of each of pixels of the LCD panel 13. In this embodiment, the parallel resonant circuit 3 is connected externally to the LCD panel 13, but a portion of the parallel resonant circuit 3 may of course be provided within the driver 12.

The LCD driving circuit according to the present invention includes at least the parallel resonant circuit 3, and may also include a portion of the driver 12.

The controller 11 need not be a central processing unit (CPU) exclusively for driving the LCD panel 13, and a generally known CPU may be used for the controller 11. For example, semiconductor chips TM57463 and TM57464 manufactured by Texas Instruments or the like may be used for the driver 12. In addition, a display panel having a known construction may be used for the LCD panel 13.

Figure 5:
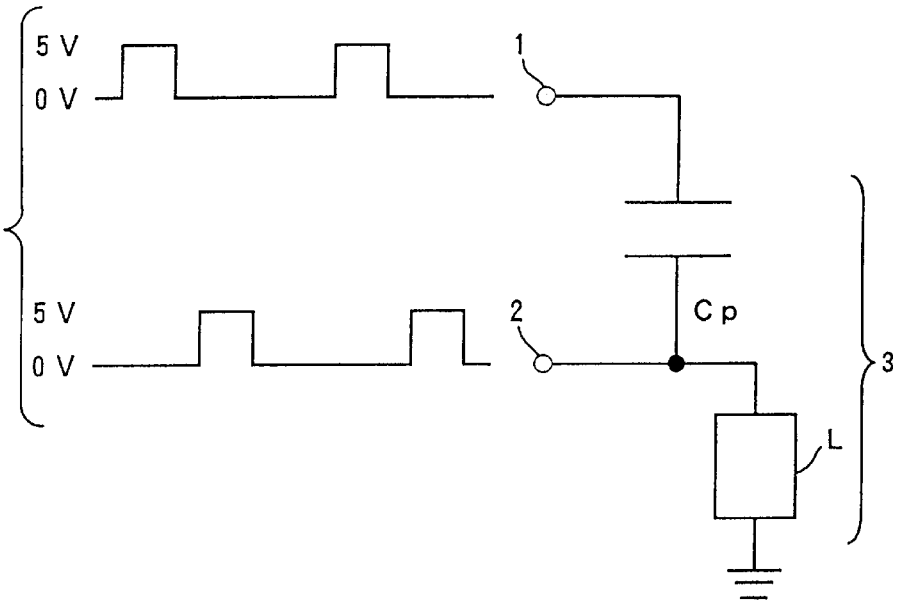
FIG. 5 is a diagram showing a first embodiment of the LCD driving circuit according to the present invention.

Next, a description will be given of a first embodiment of the LCD driving circuit according to the present invention, by referring to FIG. 5 which shows the first embodiment. In FIG. 5, those parts which are the same as those corresponding parts in FIG. 3 are designated by the same reference numerals, and a description thereof will be omitted.

In this embodiment, an inductor L having an inductance L is connected in parallel to the capacitance Cp which is indicated as a capacitor Cp in FIG. 5, and the parallel resonant circuit 3 is formed by this capacitor Cp and this inductor L. An impedance of this parallel resonant circuit 3 becomes infinitely large at an angular frequency $\omega=1/\sqrt{L\cdot Cp}$. When the frequency f of the A.C. type signal is 30 kHz, the voltage V is 5 V and the total capacitance cp of the common electrode 2 is 0.5 $\mu$F, the inductance L is 56 $\mu$H. When it is assumed for the sake of convenience that the duty ratio of the A.C. type signal is 50%, each frequency component becomes $F(n\omega)=\{\sin(n\pi/2)\}/(n\pi/2)$, and if it is assumed that $2/\pi=0.637$, the fundamental wave component (n=1) becomes $F(\omega)^2/\Sigma(F(n\omega)^2)=0.81$. This fundamental wave component is not consumed by the parallel resonance of the parallel resonant circuit 3, and in principle, the power consumption becomes $375(mW)\cdot(1-0.81)=71(mW)$ which is extremely small compared to the 375 (mW) of the conventional case described above.

Figure 6:
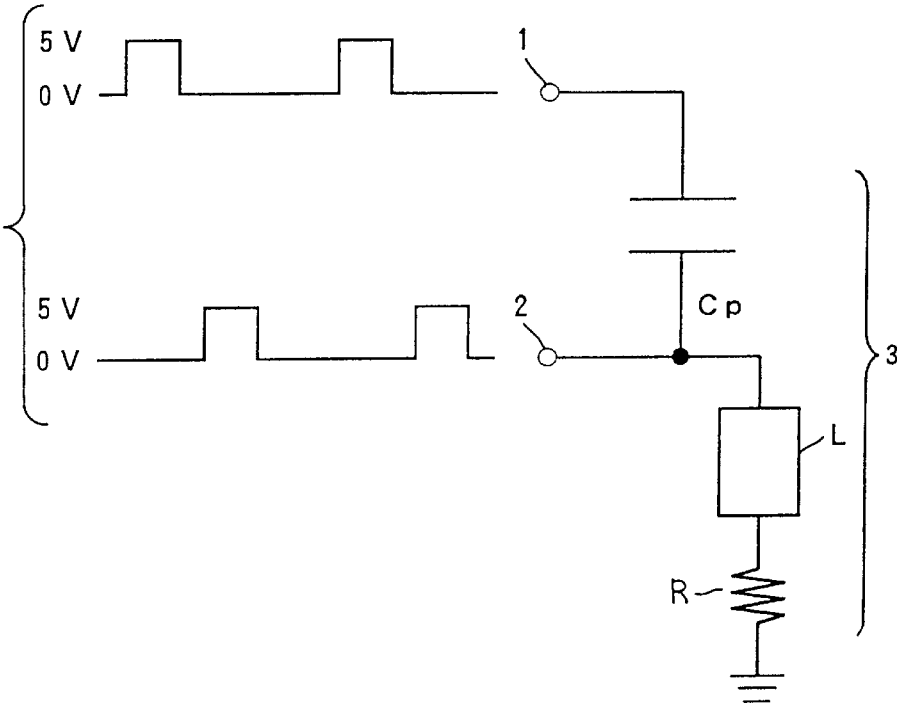
FIG. 6 is a diagram showing a second embodiment of the LCD driving circuit according to the present invention.

Next, a description will be given of a second embodiment of the LCD driving circuit according to the present invention, by referring to FIG. 6 which shows the second embodiment. In FIG. 6, those parts which are the same as those corresponding parts in FIG. 5 are designated by the same reference numerals, and a description thereof will be omitted.

In this embodiment, a resistor R having a resistance R is connected in series to the inductor L. In the first embodiment described above, the frequency of the signal which drives the common electrode 2 and the resonance frequency of the parallel resonant circuit 3 must perfectly match. However, due to inconsistencies of the individual parts, changes in characteristics of the parts due to temperature changes and the like, an error may be introduced between the frequency of the signal which drives the common electrode 2 and the resonance frequency of the parallel resonant circuit 3. Hence, although the impedance of the parallel resonant circuit 3 does not perfectly become infinitely large at the resonance point, this embodiment makes the sharp change in the impedance gradual at the resonance point of the parallel resonant circuit 3 by providing the resistor R, so as to be less affected by the inconsistencies of the individual parts, changes in characteristics of the parts due to temperature changes and the like. Other effects of this embodiment are substantially the same as those obtainable in the first embodiment.

Figure 7:
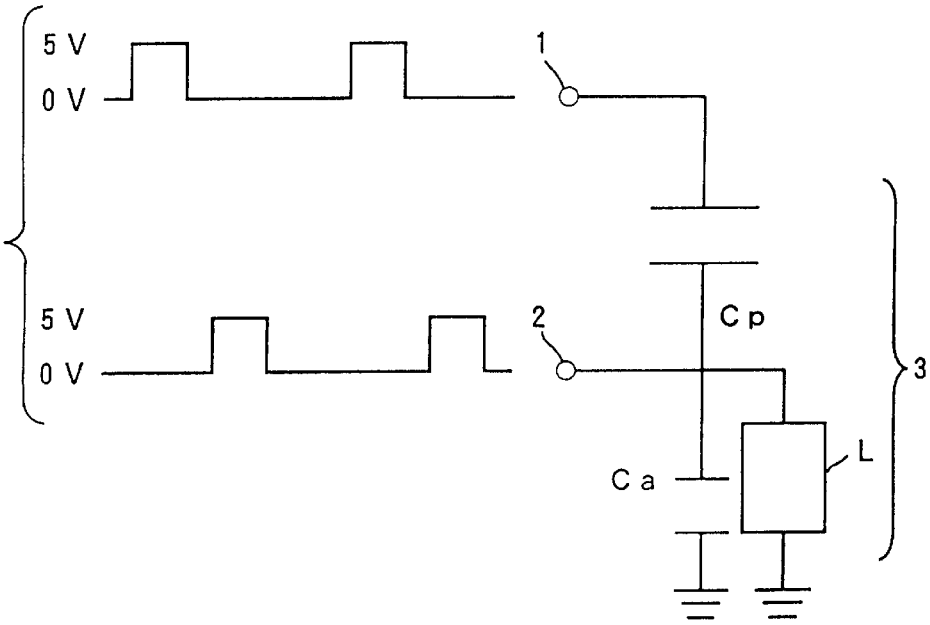
FIG. 7 is a diagram showing a third embodiment of the LCD driving circuit according to the present invention.

Next, a description will be given of a third embodiment of the LCD driving circuit according to the present invention, by referring to FIG. 7 which shows the third embodiment. In FIG. 7, those parts which are the same as those corresponding parts in FIG. 5 are designated by the same reference numerals, and a description thereof will be omitted.

In this embodiment, a capacitor Ca having a capacitance Ca is connected in parallel to the inductor L. As a result, it is easier to select the inductance L of the inductor L. For example, when the capacitance Ca is selected to 4.5 $\mu$F under the same conditions as the first embodiment shown in FIG. 5, the inductance L becomes 5.6 $\mu$H which is low compared to that of the first embodiment. Other effects of this embodiment are substantially the same as those obtainable in the first embodiment.

Figure 8:
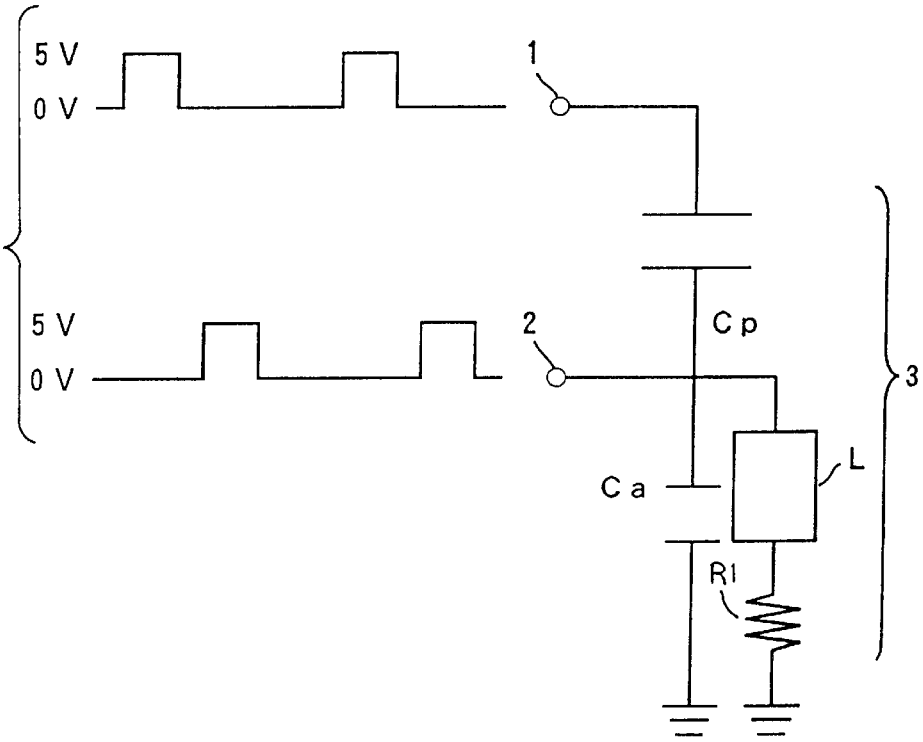
FIG. 8 is a diagram showing a fourth embodiment of the LCD driving circuit according to the present invention.

Next, a description will be given of a fourth embodiment of the LCD driving circuit according to the present invention, by referring to FIG. 8 which shows the fourth embodiment. In FIG. 8, those parts which are the same as those corresponding parts in FIG. 7 are designated by the same reference numerals, and a description thereof will be omitted.

In this embodiment, a resistor R1 having a resistance R1 is connected in series to the inductor L. In the third embodiment described above, the frequency of the signal which drives the common electrode 2 and the resonance frequency of the parallel resonant circuit 3 must perfectly match. However, due to inconsistencies of the individual parts, changes in characteristics of the parts due to temperature changes and the like, an error may be introduced between the frequency of the signal which drives the common electrode 2 and the resonance frequency of the parallel resonant circuit 3. Hence, although the impedance of the parallel resonant circuit 3 does not perfectly become infinitely large at the resonance point, this embodiment makes the sharp change in the impedance gradual at the resonance point of the parallel resonant circuit 3 by providing the resistor R1, so as to be less affected by the inconsistencies of the individual parts, changes in characteristics of the parts due to temperature changes and the like. Other effects of this embodiment are substantially the same as those obtainable in the third embodiment.

Figure 9:
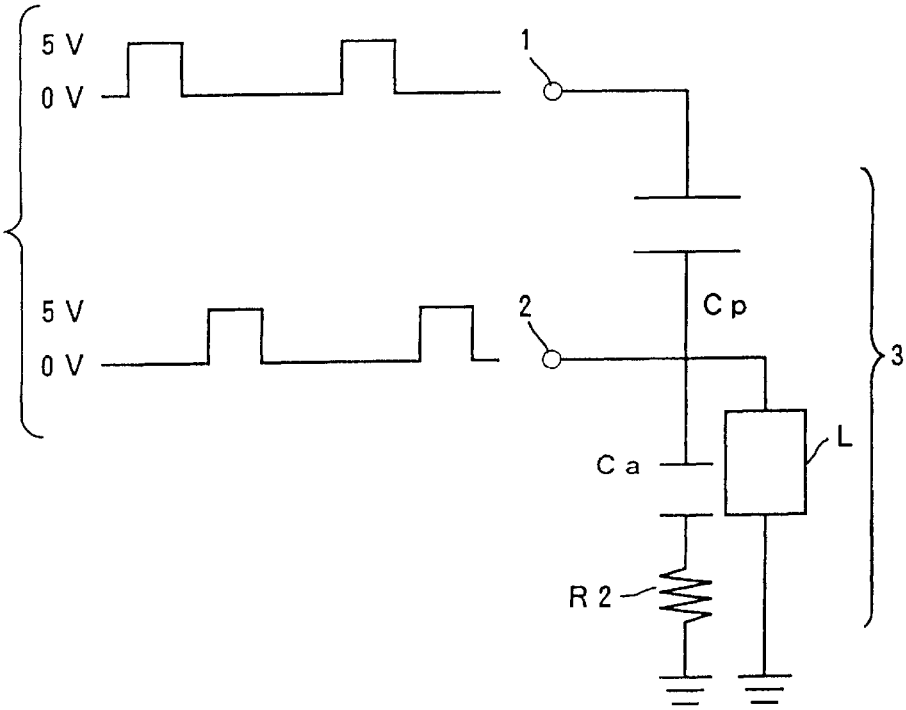
FIG. 9 is a diagram showing a fifth embodiment of the LCD driving circuit according to the present invention.

Next, a description will be given of a fifth embodiment of the LCD driving circuit according to the present invention, by referring to FIG. 9 which shows the fifth embodiment. In FIG. 9, those parts which are the same as those corresponding parts in FIG. 7 are designated by the same reference numerals, and a description thereof will be omitted.

In this embodiment, a resistor R2 having a resistance R2 is connected in series to the capacitor Ca. In the third embodiment described above, the frequency of the signal which drives the common electrode 2 and the resonance frequency of the parallel resonant circuit 3 must perfectly match. However, due to inconsistencies of the individual parts, changes in characteristics of the parts due to temperature changes and the like, an error may be introduced between the frequency of the signal which drives the common electrode 2 and the resonance frequency of the parallel resonant circuit 3. Hence, although the impedance of the parallel resonant circuit 3 does not perfectly become infinitely large at the resonance point, this embodiment makes the sharp change in the impedance gradual at the resonance point of the parallel resonant circuit 3 by providing the resistor R2, so as to be less affected by the inconsistencies of the individual parts, changes in characteristics of the parts due to temperature changes and the like. Other effects of this embodiment are substantially the same as those obtainable in the third embodiment.

Figure 10:
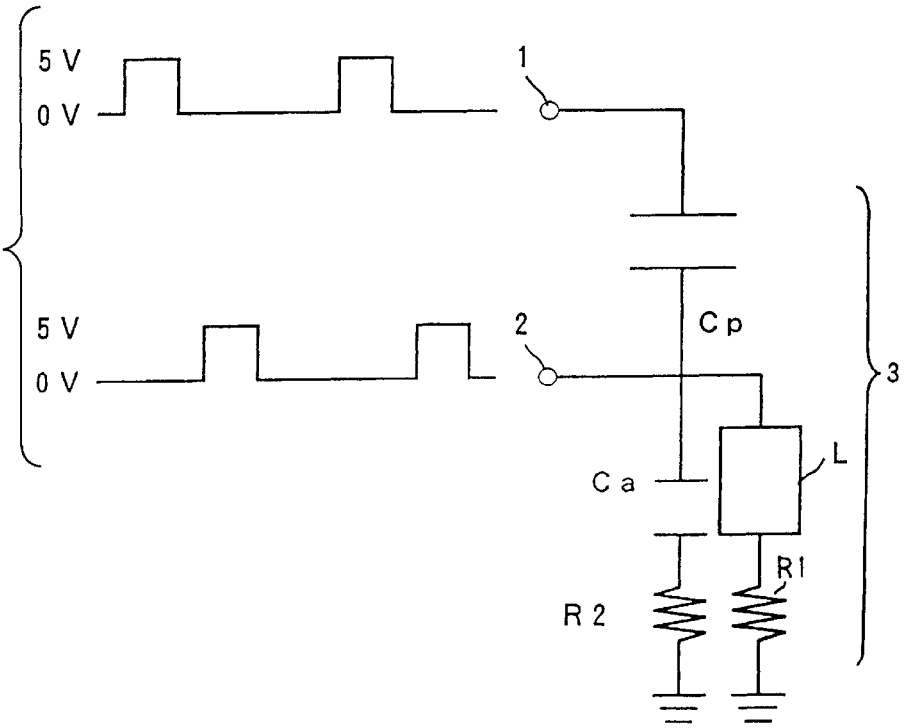
FIG. 10 is a diagram showing a sixth embodiment of the LCD driving circuit according to the present invention.

Next, a description will be given of a sixth embodiment of the LCD driving circuit according to the present invention, by referring to FIG. 10 which shows the third embodiment. In FIG. 10, those parts which are the same as those corresponding parts in FIGS.8 and 9 are designated by the same reference numerals, and a description thereof will be omitted.

In this embodiment, a resistor R1 having a resistance R1 is connected in series to the inductor L, and a resistor R2 having a resistance R2 is connected in series to the capacitor Ca. In the third embodiment described above, the frequency of the signal which drives the common electrode 2 and the resonance frequency of the parallel resonant circuit 3 must perfectly match. However, due to inconsistencies of the individual parts, changes in characteristics of the parts due to temperature changes and the like, an error may be introduced between the frequency of the signal which drives the common electrode 2 and the resonance frequency of the parallel resonant circuit 3. Hence, although the impedance of the parallel resonant circuit 3 does not perfectly become infinitely large at the resonance point, this embodiment makes the sharp change in the impedance gradual at the resonance point of the parallel resonant circuit 3 by providing the resistors R1 and R2, so as to be less affected by the inconsistencies of the individual parts, changes in characteristics of the parts due to temperature changes and the like. Other effects of this embodiment are substantially the same as those obtainable in the third embodiment.

Further, the present invention is not limited to these embodiments, but various variations and modifications may be made without departing from the scope of the present invention.

What is claimed is:

1. A liquid crystal display driving circuit which drives a liquid crystal display panel having a data electrode and a common electrode by applying a periodically inverted signal to the common electrode, said liquid crystal display driving circuit comprising:

a ground; and a parallel resonant circuit, including a static capacitance of the liquid crystal display panel, coupled to the common electrode and the ground, said parallel resonant circuit having a parallel resonance frequency equal to a frequency of the signal applied to the common electrode.

2. The liquid crystal display driving circuit as claimed in claim 1, wherein said parallel resonant circuit includes an inductor coupled between the common electrode and the ground.

3. The liquid crystal display driving circuit as claimed in claim 2, wherein said parallel resonant circuit further includes a capacitor coupled in parallel to said inductor.

4. The liquid crystal display driving circuit as claimed in claim 2, wherein said parallel resonant circuit further includes a resistor coupled in series to said inductor.

5. The liquid crystal display driving circuit as claimed in claim 1, wherein said parallel resonant circuit further includes a series circuit which is made up of an inductor and a resistor coupled in series between the common electrode and the ground, and a capacitor coupled in parallel to the series circuit.

6. The liquid crystal display driving circuit as claimed in claim 1, wherein said parallel resonant circuit further includes an inductor coupled between the common electrode and the ground, and a series circuit coupled in parallel to said inductor, said series circuit being made up of a capacitor and a resistor which are coupled in series.

7. The liquid crystal display driving circuit as claimed in claim 1, wherein said parallel resonant circuit further includes a first series circuit which is made up of an inductor and a first resistor coupled in series between the common electrode and the ground, and a second series circuit coupled in parallel to said first series circuit, said second series circuit being made up of a capacitor and a second resistor which are coupled in series.

8. A liquid crystal display unit comprising:

a liquid crystal display panel having a data electrode and a common electrode; and a liquid crystal display driving circuit driving said liquid crystal display panel by applying a periodically inverted signal to the common electrode, said liquid crystal display driving circuit having a parallel resonant circuit which includes a static capacitance of said liquid crystal display panel and is coupled to the common electrode and ground, said parallel resonant circuit having a parallel resonance frequency equal to a frequency of the signal applied to the common electrode.

9. The liquid crystal display unit as claimed in claim 8, wherein said parallel resonant circuit includes an inductor coupled between the common electrode and the ground.

10. The liquid crystal display unit as claimed in claim 9, wherein said parallel resonant circuit further includes a capacitor coupled in parallel to said inductor.

11. The liquid crystal display unit as claimed in claim 9, wherein said parallel resonant circuit further includes a resistor coupled in series to said inductor.

12. The liquid crystal display unit as claimed in claim 8, wherein said parallel resonant circuit further includes a series circuit which is made up of an inductor and a resistor coupled in series between the common electrode and the ground, and a capacitor coupled in parallel to the series circuit.

13. The liquid crystal display unit as claimed in claim 8, wherein said parallel resonant circuit further includes an inductor coupled between the common electrode and the ground, and a series circuit coupled in parallel to said inductor, said series circuit being made up of a capacitor and a resistor which are coupled in series.

14. The liquid crystal display unit as claimed in claim 8, wherein said parallel resonant circuit further includes a first series circuit which is made up of an inductor and a first resistor coupled in series between the common electrode and the ground, and a second series circuit coupled in parallel to said first series circuit, said second series circuit being made up of a capacitor and a second resistor which are coupled in series.

* * * * *